US005204698A

United States Patent [19]

LeSueur et al.

[11] Patent Number: 5,204,698

[45] Date of Patent: Apr. 20, 1993

[54] TONER MONITORING IN AN ELECTROSTATOGRAPHIC DIGITAL PRINTING MACHINE

[75] Inventors: Eric J. LeSueur, Wembley; Krzysztof J. Less, London, both of United Kingdom

[73] Assignee: Xerox Corporation, Stamford, Conn.

[21] Appl. No.: 936,704

[22] Filed: Aug. 27, 1992

[30] Foreign Application Priority Data

Sep. 11, 1991 [GB] United Kingdom ..... 9119484

[51] Int. Cl.[5] ..... G03G 15/06; G03G 15/08

[52] U.S. Cl. ..... 346/160; 355/208; 355/246; 222/DIG. 1

[58] Field of Search ..... 346/160; 355/208, 245, 355/246; 118/688-690; 222/58, 63, DIG. 1

[56] References Cited

U.S. PATENT DOCUMENTS

| | | | |
|---|---|---|---|
| 3,409,901 | 11/1968 | Dost et al. | 346/74 |
| 3,873,002 | 3/1975 | Davidson et al. | 222/56 |
| 4,468,112 | 8/1984 | Suzuki et al. . | |
| 4,847,659 | 7/1989 | Resch, III | 355/202 |
| 4,908,666 | 3/1990 | Resch, III | 355/246 |
| 4,974,024 | 11/1990 | Bares et al. | 355/246 |
| 5,124,751 | 6/1992 | Fukui et al. | 355/246 |

OTHER PUBLICATIONS

*Patent Abstracts of Japan*, vol. 13, No. 327, Pub. Jul. 24, 1989, for Japanese Patent Document 01-108070, Publication date of Japanese Document Apr. 25, 1989.

*Primary Examiner*—R. L. Moses

[57] ABSTRACT

In a laser printer, in which a latent image is generated on a circulating imaging member in accordance with digital image signals and subsequently developed with toner, the number of pixels to be toned is used as an indication of the rate at which toner is being depleted from the developer mixture. The device for dispensing fresh toner to the developer mixture is operated in dependence on the number of pixels to be toned so that there is a pre-established relationship between the pixel count and the length of time for which the dispensing device is in operation. If the efficiency of the dispensing device falls, the pre-established relationship is adjusted so that the toner density in the developed images remains constant. If a predetermined level of adjustment is reached, it is taken as an indication that the supply of toner in the printer is low, and should be replenished.

5 Claims, 3 Drawing Sheets

TONER MONITORING IN AN ELECTROSTATOGRAPHIC DIGITAL PRINTING MACHINE

The present invention relates to toner (developer) supply control in electrostatographic printing/digital copying machines in which an electrostatic latent image is formed on an imaging member by a printing head and is subsequently developed. The imaging member may, for example, be a photoreceptor belt and the printing head may be a laser device which directs a laser beam at the photoreceptor belt in accordance with image input signals.

It is known to monitor the concentration of toner in the developer mixture that is used to develop the latent image and to replenish the mixture with toner when necessary. Toner concentration can, for example, be monitored by measuring the toner density in the developed images and, to that end, it is known to generate test patches on the imaging member and measure the amount of toner deposited on the test patches during image development. That technique can be employed in electrostatographic copiers as well as printers.

In electronic printing/digital copying machines, it is possible to measure toner usage by monitoring the number of print signals applied to the printing head and to replenish the developer mixture with toner accordingly. Printing machines in which that approach is adopted are described in U.S. Pat. Nos. 3,409,901, 4,847,659 and 4,908,666. Noted by the UK PO as relevant to the parent UK application is Canon U.S. Pat. No. 4,468,112, issued Aug. 28, 1984 to A. Suzuki, et al.

Also, particularly noted is U.S. Pat. No. 3,873,002 re the Xerox Corporation "6500" color copier toner dispensing control system.

Further by way of background art, "low toner", i.e., toner replenishment indicators for copier and/or printer operators typically require a piezoelectric crystal vibrator, or an optical, acoustical or other such separate sensor in or adjacent to the toner powder hopper itself, where it may have accuracy or reliability problems, e.g., may be affected by toner contamination, "toner bridging" air pockets in the hopper, etc.. See, e.g., U.S. Pat. Nos. 3,896,279; 3,920,154; 3,979,022 and 4,133,459.

In the machine described in U.S. Pat. No. 3,409,901, the printing head is a cathode ray tube (CRT) and is used to generate latent images on a photoconductive drum. The intensity of the beam that is directed from the CRT at the photoconductive drum is modulated in dependence on an input signal which is also used to provide an indication of the size of the black areas to be printed and, hence, of toner usage.

U.S. Pat. Nos. 4,847,659 and 4,908,666 both describe electrostatographic printers in which the printing head comprises an array of light-emitting diodes (LED's). Toner replenishment is controlled in dependence on the number of sheets printed or the number of characters or, preferably, the number of pixels to be toned.

The present invention is concerned with detecting, in an electrostatographic printing/digital copying machine, that the toner supply from which the developer mixture is replenished has fallen to a low level.

The present invention provides an electrostatographic printing/digital copying machine comprising a circulating imaging member; a printing head operable, in accordance with image signals, to generate a latent image on the imaging member; a developer device operable to develop the latent image with toner, and means for dispensing toner to the developer device from a toner supply; means for assessing the extent of the toned area in an image to be printed and for operating the dispensing means in accordance with that assessment, wherein there is a pre-established relationship between the said assessment and the length of time for which the dispensing means is in operation; means for monitoring the toner density of developed images and arranged to adjust the said pre-established relationship in dependence on the toner density, and means for monitoring the adjustment and, at a predetermined point, indicating that the toner supply requires replenishment.

In an embodiment of the invention described herein, the means for assessing the extent of the toned area in an image to be printed is operable to count the number of pixels to be toned.

The printing head may conventionally comprise a laser device operable to direct a laser beam at the imaging member, and means for modulating the beam in accordance with the image signals, or an LED array.

The means for monitoring toner density may be conventionally operable to monitor the reflectance of developed images on the imaging member.

By way of example only, an embodiment of the invention will now be described with reference to the accompanying drawings, in which.

Figure 1:
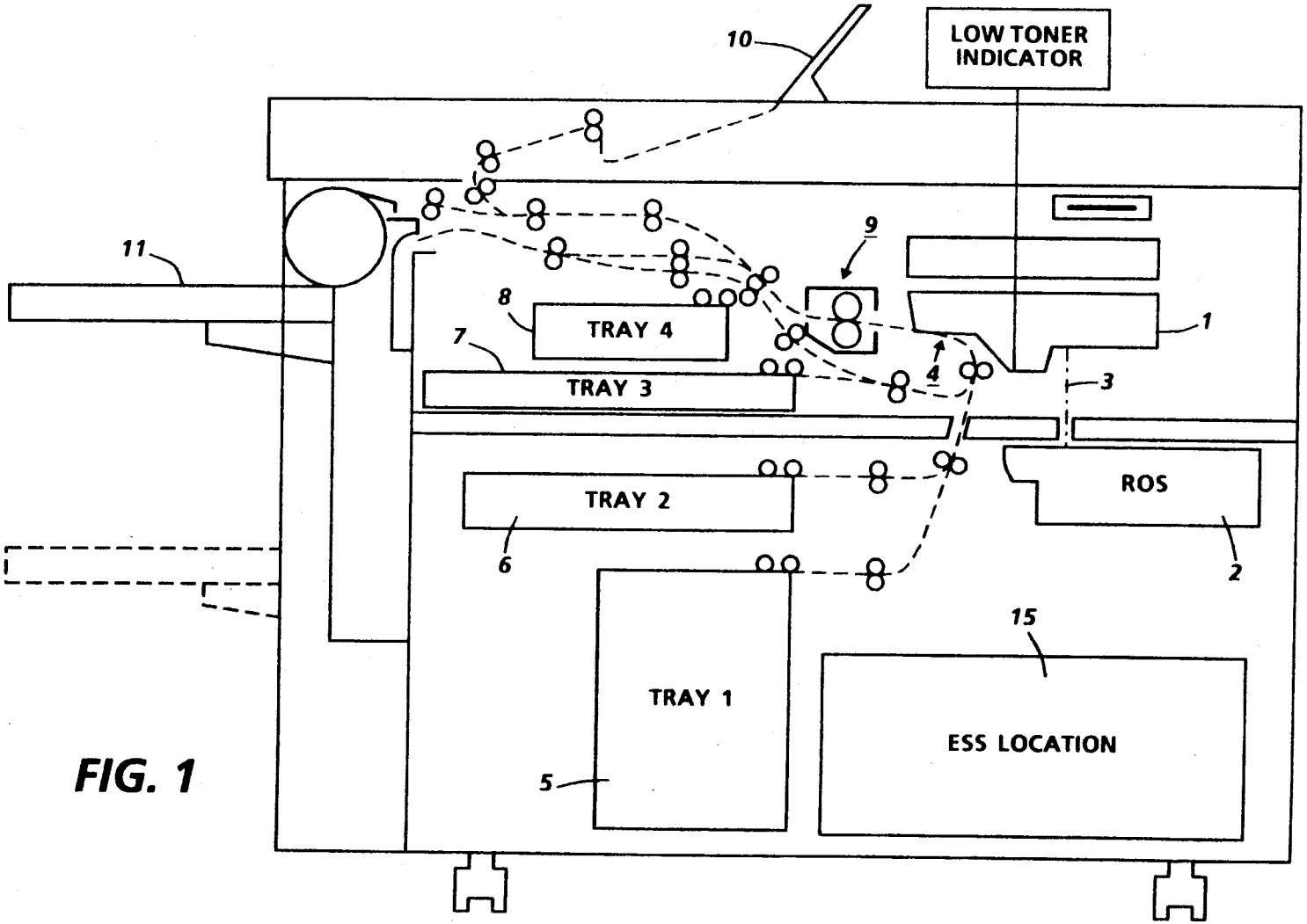
FIG. 1 is a diagrammatic view of a printing machine embodying the invention.
Figure 2:
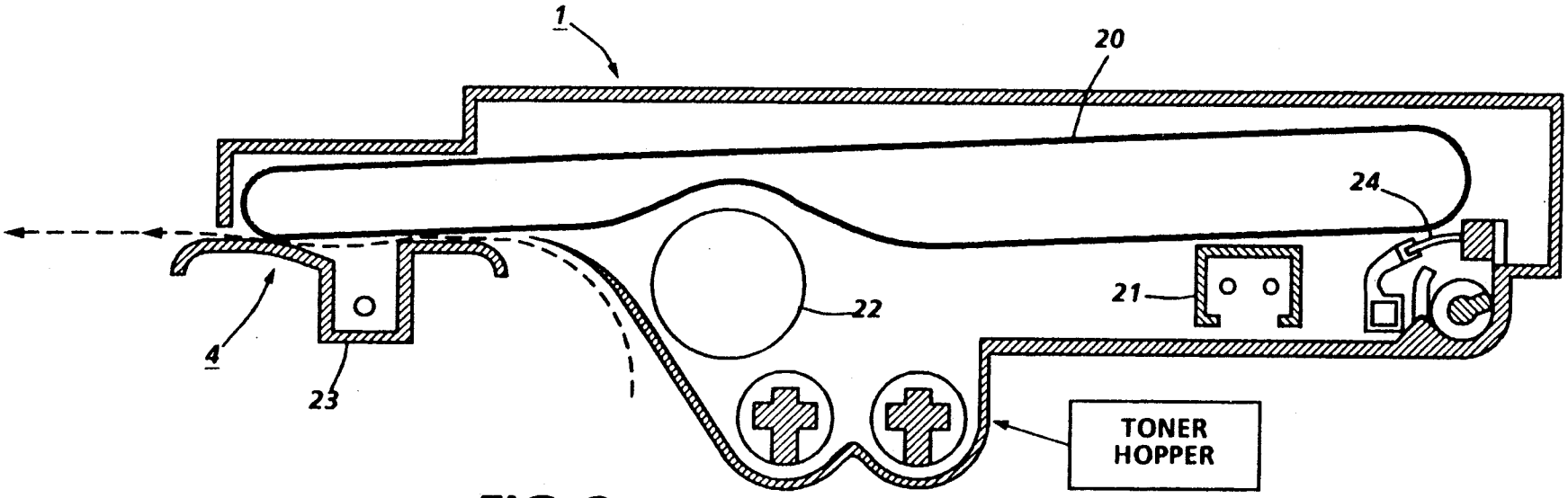
FIG. 2 is a schematic cross-section of a replaceable cassette which forms part of the machine shown in FIG. 1.

FIG. 1 shows a laser printer employing a replaceable xerographic cassette 1 which is shown in greater detail in FIG. 2. A xerographic imaging member in the form of an endless flexible photoreceptor belt 20 is housed within the cassette 1, together with other xerographic process means as described below. A raster output scanner (ROS) 2 provides an imaging beam 3 which is directed at the photoreceptor belt through an imaging slit in the cassette 1 to form an electrostatic latent image on the belt. The image is developed within the cassette and is transferred, at a transfer station 4, to a copy sheet which is fed to that location from one of four supply trays 5, 6, 7 and 8. The transferred image is fused to the copy sheet at a fusing station 9 and the copy sheet may then be delivered from the printer to be collected either in a sample tray 10 on top of the machine or in a stacking tray 11 on the side of the machine. Alternatively, a copy sheet with a fused image on one side only may be put into a trayless duplex path within the machine and returned to the transfer station to receive an image on the other side before being delivered from the machine into one of the trays 10, 11. The various copy sheet paths within the machine are indicated in broken lines in FIGS. 1 and 2.

The cassette 1 may be similar to that described in U.S. Pat. No. 4,831,407. In addition to the photoreceptor belt 20, it includes a charge corotron 21; a developer device 22; a transfer corotron 23 and a cleaning device 24. The charge corotron 21 is located upstream of the imaging slit in the cassette to deposit a uniform electrostatic charge on the surface of the belt before it is exposed to the imaging beam 3. The developer device 22 is located downstream of the imaging slit to bring developer mixture into proximity with, and thereby develop, the electrostatic latent image on the belt. The developer mixture is a two-component mixture comprising toner and a magnetically-attractable carrier. Toner is transferred to the belt when images are developed, and so, to maintain the concentration of toner in the developer mixture, conventionally a known toner dispensing motor (shown schematically in FIG. 3) is operated periodically to deliver toner from a known toner hopper (shown schematically in FIG. 3) into the housing of the developer device 22. The transfer corotron 23 is located at the transfer station 4 to assist in transferring the developed image from the belt to the copy sheet which enters the cassette at that point. Finally, the cleaning device 24 removes any residual toner particles from the surface of the photoreceptor belt which is then illuminated by a discharge lamp to remove any electrostatic charge remaining on the belt.

The cassette 1, as already mentioned, is removable from the printer and can be replaced by another cassette if any of the process elements begins to deteriorate. Alternatively, it can be replaced by a cassette which contains toner of a different colour.

The raster output scanner 2 incorporates a He-Ne laser to generate the imaging beam 3, a conventional rotating polygon device to sweep the beam across the surface of the photoreceptor belt, and an acoustic modulator. The beam is modulated in accordance with input signals received from a remote source, for example a user interface and keyboard (not shown). The operation of a raster output scanner of that type to generate a latent image on a photoreceptor is well understood and need not be described here. The processing of the image signals from the remote source is handled by an electronic sub-system of the printer, indicated at 15, while operation of the printer generally is under the control of a machine control unit (not shown).

The print density of developed images is maintained at a constant level in the machine of FIG. 1 by dispensing toner to the developer system in proportion to the number of black pixels to be developed. The procedure is summarized in FIG. 3. Generally, for every cycle of the photoreceptor belt in print mode, the number of black pixels in the images to be laid down over that cycle is assessed and the result is used by the central processor of the machine control unit to compute the time for which the toner dispense motor should be run during that cycle of the photoreceptor belt. Thus, if the assessed number of black pixels for a cycle increases, the toner dispense motor will be run for a greater length of time during that cycle to add a greater amount of toner to the developer mixture. The black pixels count can be made at the interface board between the ESS 15 and the acoustic modulator of the raster output scanner 2, or it can be made in the ESS 15 during processing of image signals.

Figure 3:
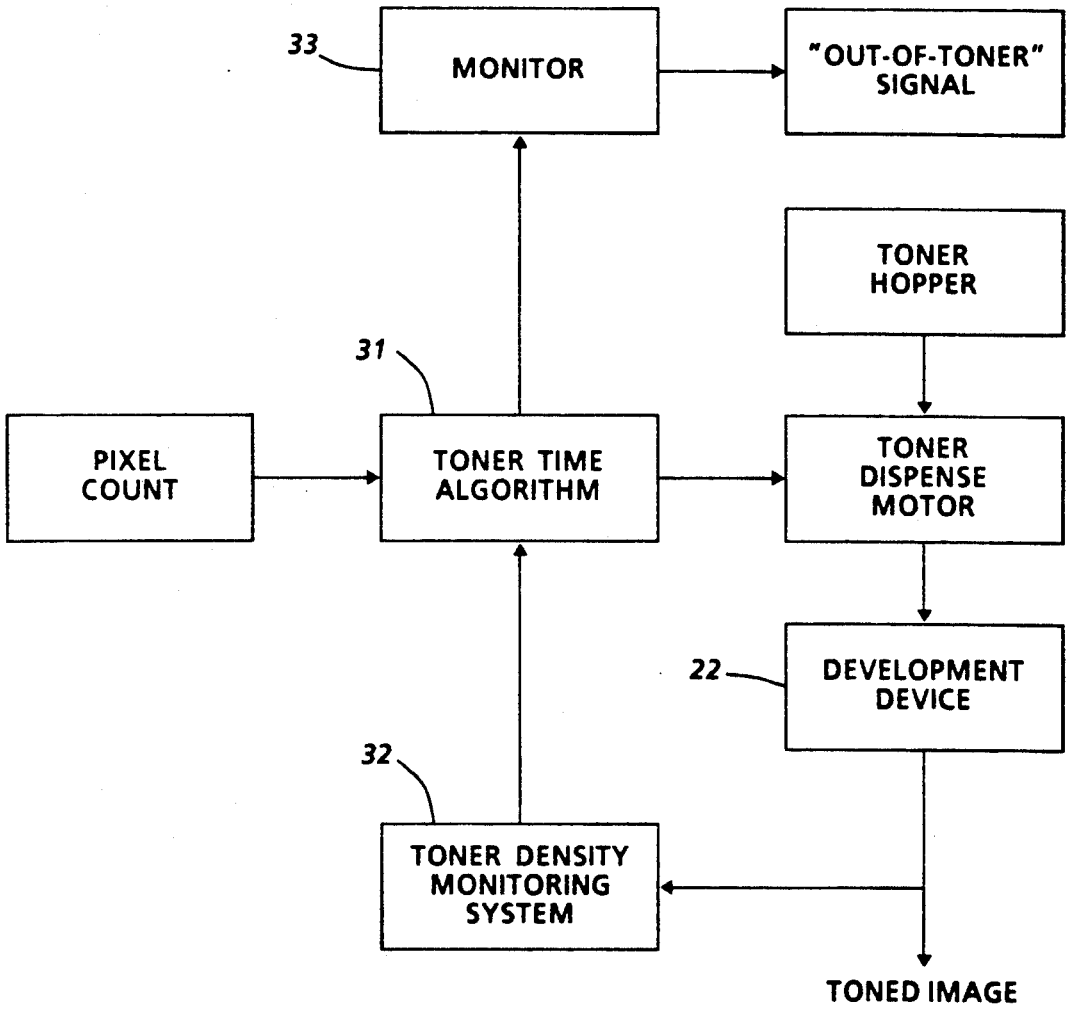
FIG. 3 is s diagram illustrating the detection of an "out-of-toner" condition in the machine of FIG. 1.

Other factors being equal, there will be a constant relationship between the black pixel count for a photoreceptor cycle and the operation of the toner dispensing motor, indicated in FIG. 3 by the "Toner Time Algorithm" box 31. However, because the efficiency of the toner dispense system varies, depending on the amount of toner available in the supply hopper, it is desirable to be able to modify the "Toner Time Algorithm" to take account of that fact. In the machine shown in FIG. 1, the appropriate modification is determined by monitoring the toner density of developed images on the photoreceptor belt 20 of the printing machine. The monitoring system may, for example, comprise means for generating a test patch on the photoreceptor and a sensor for measuring the reflectance of the developed patch to determine the toner density. Toner density monitoring systems of that type are well known and need not be described here. One such system is described, for example, in U.S. Pat. No. 4,551,004.

The output of the toner density monitoring system (indicated by the box 32 in FIG. 3) is used to modify the "Toner Time Algorithm" when necessary and, hence, the relationship between the black pixel count and the length of time in each cycle for which the toner dispense motor should be run. More particularly, it is found that the efficiency of the toner dispense system falls as the amount of toner in the supply hopper decreases and it is necessary to run the toner dispense motor for longer in any one cycle to dispense the same amount of toner. The necessary adjustment is made in the machine control unit by altering the "Toner Time Algorithm" 31 in dependence on the output of the density monitoring system 32 so that, for a given black pixel count, the toner dispense motor will run for longer when the toner density monitoring system indicates a drop in image toner density. As the toner supply hopper approaches the empty state, the correction factor applied to the "Toner Time Algorithm" becomes larger so that the size of the correction factor can be used as an indication of the amount of toner left in the hopper. When the correction factor exceeds a certain level, the machine controller generates a signal to the machine operator that the machine is "out-of-toner" and that a new toner cartridge should be inserted (box 33 in FIG. 3).

An appropriate microprocessor program which will enable the machine control unit to carry out the above procedure can be provided on the basis of the above description, having regard to the particular machine in which the procedure is to be implemented.

The use, in the above-described machine, of a count of the black pixels to regulate the toner dispensing system enables the machine to respond rapidly to changes in coverage from one photoreceptor cycle to another and one image to another. The pixel count signal, indicating area coverage, can be made available as toner is being dispensed, that is, before the need to dispense toner becomes apparent from the toner density in the developed images. The toner density monitoring system (box 32 in FIG. 3) can then be better used for fine tuning of the control of the toner dispense motor and providing an "out-of-toner" signal to the operator, leading to improved control and enhanced system stability.

Where reference is made above to a count of black pixels, it will be understood toner of any other colour is included and that the procedure is not applicable only when black toner is being used in the printing machine. The count of black (or other colour) pixels is, effectively, an assessment of the extent of the toned area in an image to be printed, regardless of the colour of the toner.

It will appreciated the procedure described above, and illustrated in FIG. 3, for indicating that the toner supply is low is not restricted to use only in a printer of the type illustrated in FIG. 1. A similar procedure could be applied to other printers and digital copiers in which advance information is available on the extent of the black areas in an image to be printed.

What is claimed is:

1. An electrostatographic printing/digital copying machine comprising a circulating imaging member; a printing head operable, in accordance with image signals, to generate a latent image on the imaging member; a developer device operable to develop the latent image with toner, and means for dispensing toner to said developer device from a toner supply; means for assessing the extent of the toned area in an image to be printed and for operating the dispensing means in accordance with that assessment, wherein there is a pre-established relationship between said assessment and the length of time for which said toner dispensing means is in operation; means for monitoring the toner density of developed images and arranged to adjust said pre-established relationship in dependence on the monitored toner density, and means for monitoring said adjustment and, in response to a predetermined said adjustment point, indicating that said toner supply is depleted and requires replenishment.

2. A machine as claimed in claim 1, in which the printing head generates variable numbers of pixels to be toned, and said means for assessing the extent of the toned area in an image to be printed counts the number of pixels to be toned.

3. A machine as claimed in claim 1, in which the printing head comprises a laser device operable to direct a laser beam at the imaging member, and means for modulating the beam in accordance with the image signals to generate image pixels.

4. A machine as claim in claim 1, in which the means for monitoring toner density is operable to monitor the reflectance of developed images on the imaging member.

5. A machine as claimed in claim 2, wherein said relationship adjustment is a toner dispensing motor operation time length correction factor, controlled by said measured toner density, and wherein said means for indicating that the said toner supply requires replenishment is actuated by said correction factor exceeding a pre-set level which is out of the normal adjustment range.

* * * * *